US006941707B2

(12) United States Patent
Sigmund

(10) Patent No.: US 6,941,707 B2
(45) Date of Patent: Sep. 13, 2005

(54) VENTED SOFFIT PANEL

(75) Inventor: John L. Sigmund, Holland, OH (US)

(73) Assignee: CertainTeed Corporation, Valley Forge, CA (US)

( * ) Notice: Subject to any disclaimer, the term of this patent is extended or adjusted under 35 U.S.C. 154(b) by 0 days.

(21) Appl. No.: 10/428,554

(22) Filed: May 2, 2003

(65) Prior Publication Data

US 2004/0216397 A1 Nov. 4, 2004

(51) Int. Cl.[7] ..... E04D 1/30; E04D 13/152; E04B 1/70; E04F 13/00

(52) U.S. Cl. ..... 52/95; 52/302.1; 52/537

(58) Field of Search ..... 52/94, 95, 302.1, 52/536, 537, 539, 558, 783.11, 310; D25/123, 125; 428/116

(56) References Cited

U.S. PATENT DOCUMENTS

| | | | | | |
|---|---|---|---|---|---|
| 849,427 | A | * | 4/1907 | Rude | 52/581 |
| 1,029,864 | A | * | 6/1912 | Glodsmith | 52/674 |
| 1,728,934 | A | * | 9/1929 | Hogenson | 206/322 |
| 2,934,934 | A | * | 5/1960 | Berliner | 52/601 |
| 3,159,943 | A | | 12/1964 | Sugar et al. | |
| 3,195,699 | A | * | 7/1965 | Johnston | 52/364 |
| 3,246,436 | A | | 4/1966 | Roush | |
| 3,289,380 | A | | 12/1966 | Charniga, Jr. | |
| 3,417,519 | A | * | 12/1968 | Hitter | 52/11 |
| 3,555,762 | A | * | 1/1971 | Costanzo | 52/588.1 |
| 4,048,960 | A | * | 9/1977 | Barnidge et al. | 119/529 |
| 4,091,743 | A | * | 5/1978 | Lemon | 105/375 |
| 4,102,106 | A | | 7/1978 | Golder et al. | |
| 4,188,762 | A | | 2/1980 | Tellman | |
| 4,251,970 | A | * | 2/1981 | Home | 52/674 |
| 4,263,752 | A | * | 4/1981 | Jungbluth | 49/501 |
| 4,607,753 | A | * | 8/1986 | Radek | 211/94.01 |
| 4,665,675 | A | | 5/1987 | Kelly | |
| 4,695,033 | A | * | 9/1987 | Imaeda et al. | 249/189 |
| 4,870,798 | A | * | 10/1989 | Richter | 52/528 |
| 4,930,287 | A | | 6/1990 | Volk et al. | |
| 5,016,415 | A | | 5/1991 | Kellis | |
| 5,022,207 | A | | 6/1991 | Hartnett | |
| 5,167,104 | A | | 12/1992 | Alvarado | |
| 5,195,283 | A | | 3/1993 | MacLeod et al. | |
| 5,243,793 | A | | 9/1993 | MacLeod et al. | |
| 5,303,525 | A | | 4/1994 | Magee | |
| 5,507,126 | A | * | 4/1996 | Wu | 52/536 |
| 5,551,204 | A | * | 9/1996 | Mayrand | 52/795.1 |
| 5,718,086 | A | | 2/1998 | Dunn | |
| 5,791,985 | A | | 8/1998 | Schiedegger et al. | |
| 5,799,446 | A | | 9/1998 | Tamlyn | |
| 5,809,731 | A | | 9/1998 | Reiss | |
| 5,881,502 | A | | 3/1999 | Tamlyn | |
| 5,937,592 | A | | 8/1999 | Tamlyn | |
| 5,946,876 | A | | 9/1999 | Grace, Sr. et al. | |
| 5,947,816 | A | | 9/1999 | Schiedegger et al. | |
| 5,956,914 | A | | 9/1999 | Williamson | |
| 6,134,855 | A | | 10/2000 | Beck | |
| 6,164,467 | A | * | 12/2000 | DePottey et al. | 211/189 |
| 6,185,899 | B1 | * | 2/2001 | De Niet | 52/762 |
| 6,223,488 | B1 | * | 5/2001 | Pelfrey et al. | 52/302.1 |
| 6,354,045 | B1 | * | 3/2002 | Boone et al. | 52/95 |
| 6,516,577 | B2 | * | 2/2003 | Pelfrey et al. | 52/302.1 |

OTHER PUBLICATIONS

Alside "Charter Oak" soffit sample and description, web page.
Crane Plastics "Premium Point" soffit sample and description, web page.
Heartland "Woodhaven" soffit sample and description, web page.
Louisiana Pacific "I–Span" soffit sample and description, web page.

* cited by examiner

*Primary Examiner*—Robert Canfield
(74) *Attorney, Agent, or Firm*—Duane Morris LLP

(57) ABSTRACT

A cladding product which includes a panel having at least one panel section and at least one longitudinal recess. The longitudinal recess includes a first channel portion adjacent to the panel section and a second channel portion adjacent to the first channel portion. The second channel portion includes at least one edge portion that extends wider than the first channel portion at a distal end of the first channel portion. The second channel portion includes a plurality of ventilation openings formed on the at least one edge portion.

13 Claims, 5 Drawing Sheets

VENTED SOFFIT PANEL

FIELD OF THE INVENTION

This present invention relates to an apparatus for use in building construction, and in particular, to an apparatus such as a soffit panel including venting which is not viewable by the human observer.

BACKGROUND OF THE INVENTION

It is common practice to cover the exterior surfaces of buildings with aluminum or vinyl sheathing, also referred to as siding or cladding, to protect the building and to provide a durable, aesthetically pleasing finish. Conventional siding is generally comprised of long strips or panels which are attached to one another to cover the exterior surface of the building.

A particular type of siding known as 'soffit' siding is generally used to cover the underside of roofs or eaves. Soffit siding is typically installed underneath the roof and disposed so as to face a human observer standing there. Additionally, soffit siding generally includes venting apertures which permit air to circulate behind the panel to prevent condensation and allow water vapor to escape. Typically, these venting apertures are holes disposed in the soffit siding panel. In most conventional soffit siding panels, these venting apertures can be seen by the casual human observer standing underneath the roof. Many people find these venting apertures to be aesthetically displeasing as they cause the soffit siding to appear discontinuous. Some people request that builders use non-vented soffit siding due to the appearance of vented siding, even though there may be physical drawbacks to non-vented siding (e.g., condensation buildup in the roof). Therefore, siding manufacturers must produce both vented and non-vented siding to meet the needs of the end customer.

Without proper ventilation, moisture may get trapped between the soffit panels and the building surfaces. This trapped moisture can create mold or structural damage such as rotting of the building components, and, in cold weather, when the moisture turns to ice, the ice can damage roofing components.

Soffit panels have been developed which allow for air circulation behind the panels. Typically, these vented soffit panels contain perforations on portions of the soffit which are visible after installation. The presence of the perforations may reduce the pleasing aesthetic appearance of the soffit panels.

U.S. Pat. No. 5,195,283 to MacLeod et al. teaches a conventional soffit siding panel and method for securing to a building. FIG. 1 of the '283 patent shows a non-vented soffit panel 16 mounted underneath a roof 10. The soffit panel 16 is secured in J-channel brackets 18 which are, in turn, secured to board 13, fascia board 14 and outside wall 12 of the building. With reference to FIG. 1, the '283 patent teaches that holes or perforations must be cut in the soffit panel 16 to provide ventilation.

FIG. 1A of the '283 patent shows a vented mounting bracket 20 for mounting the soffit panel 16. The vented mounting bracket 20 may have been believed by the inventors of the '283 to eliminate the need to cut holes in the soffit panel 16 to provide ventilation due to preformed holes 25 disposed in the mounting bracket. However, this mounting bracket is not aesthetically pleasing to the casual observer, and thus other structures for venting soffit panels have recently been invented. Some of these products are discussed below.

Crane Plastics (www.vinyl-siding.com) advertises a soffit panel called "Premium Pointe™ Soffit" which comprises a concealed vented soffit panel. However, this product includes venting flaps which remain viewable at certain angles due primarily to the shape of the ventilation channel (groove). U.S. Pat. No. 6,223,488 to Pelfrey et al., a patent assigned to Crane Plastics, appears to show the basic structure of the Premium Pointe™ product. The ventilation channel (groove) 6 including ventilation flaps 7 is shown in FIGS. 1–3 of the '488 patent. As shown in FIGS. 1 and 3 of the '488 patent, the ventilation flaps 7 are easily viewable from a position underneath the siding panel 1.

Alside, Inc. (www.alside.com) advertises a soffit panel product called "Charter Oak™ Soffit" which includes concealed ventilation openings. Again, however, these ventilation openings are viewable at certain angles due to the shape of the ventilation channel.

Lousiana-Pacific Corporation (www.lpcorp.com) manufactures a soffit panel product called "I-Span™" which also includes concealed venting holes, but again, due primarily to the shape of the ventilation channel, the ventilation openings remain viewable at certain angles.

Finally, Heartland (www.heart-land.com) produces a soffit panel product called "Woodhave™" which similarly includes concealed ventilation openings. Again, however, these ventilation openings are viewable at certain angles due to the shape of the ventilation channel.

Thus, there is presently a need for a vented soffit panel which includes ventilation openings which provide efficient venting, and which are not viewable to the casual human observer.

SUMMARY OF THE INVENTION

The present invention is a cladding product including a panel having at least one panel section and at least one longitudinal recess. The at least one longitudinal recess includes a first channel portion adjacent to the at least one panel section, and a second channel portion adjacent to the first channel portion. The second channel portion includes at least one edge portion that extends wider than the first channel portion at a distal end of the first channel portion. The second channel portion includes a plurality of openings on the at least one edge portion.

The present invention also comprises a vented siding panel with a planar main body member including at least one ventilation channel disposed therein, where in said at least one ventilation channel includes a base portion and a cap portion, and where a periphery of the cap portion extends beyond a periphery of the base portion.

The present invention also comprises a method for manufacturing a sheathing member, including the steps of extruding a polymeric sheet having a longitudinal recess therein and forming at least one ventilation hole in the wall of the recess on a first side of the sheet such that at least one ventilation hole is formed in said wall which is not viewable from an opposing side of the sheet.

BRIEF DESCRIPTION OF THE DRAWINGS

The present invention will be further described with reference to the following drawings.

DETAILED DESCRIPTION

Figure 1A:
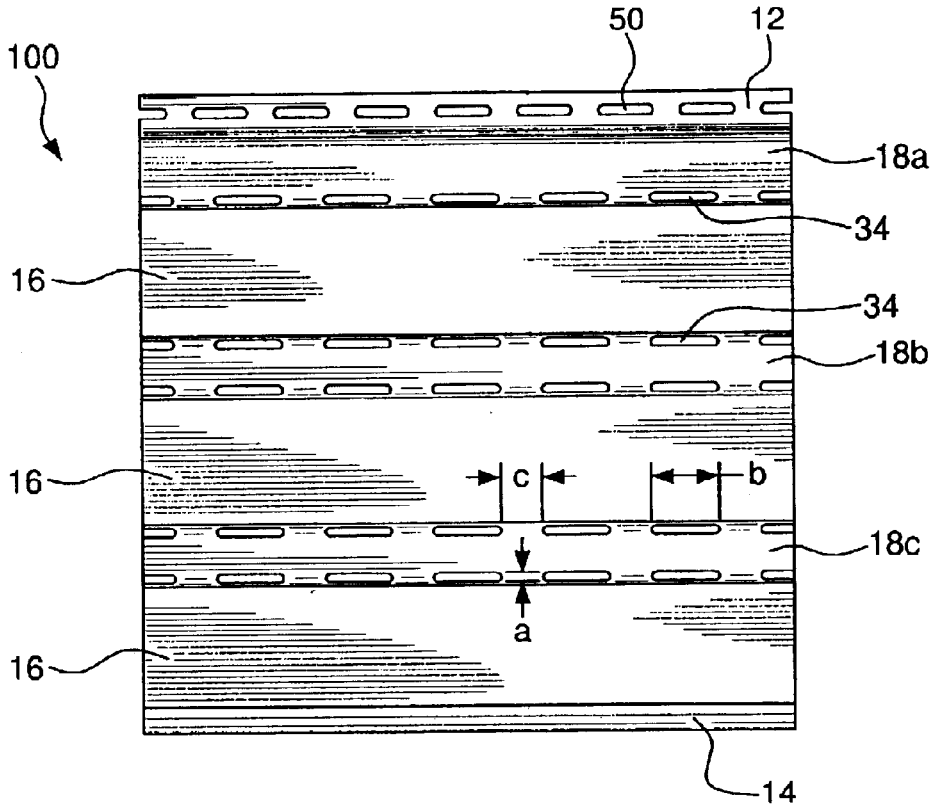
FIG. 1A is a top plan view of a cladding product according to a first exemplary embodiment of the present invention.

Referring to FIGS. 1A–D, a cladding product according to a first exemplary embodiment is shown comprising a panel 100. Panel 100 includes a first longitudinal edge portion 12, a second longitudinal edge portion 14, a plurality of panel sections 16 and a plurality of longitudinal recesses 18*a*, 18*b* and 18*c*. The longitudinal recesses 18*a*, 18*b* and 18*c* are substantially parallel to the first and second longitudinal edge portions 12, 14 and one or more of the longitudinal recesses 18*a*, 18*b* and/or 18*c* separate the panel 100 into panel sections 16. As shown in FIG. 1A, the longitudinal recess 18*a* adjacent to first longitudinal edge portion 12 is adjacent to only one panel section.

The cladding product preferably comprises a vented siding panel (such as a vented soffit panel), but may include other types of exterior covering for buildings. The cladding product may be formed of suitable material, including, for example, fibercement, vinyl ("pvc") or aluminum.

Figure 1B:
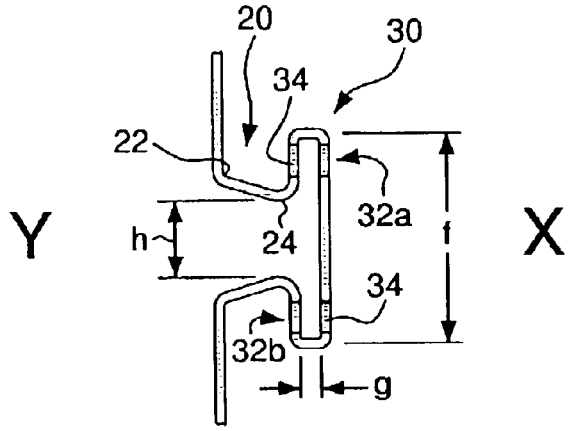
FIG. 1B is a cross-sectional side view of a longitudinal recess of the cladding product of FIG. 1A.

Referring to FIGS. 1A and 1B, at least one of the longitudinal recesses 18, and preferably each of the longitudinal recesses 18*a–c*, comprises a ventilation channel with a first channel portion 20 (also referred to herein as a "base" portion) and a second channel portion 30 (also referred to herein as a "cap" portion). The first channel (base) portion 20, at its proximal end 22, is adjacent to at least one panel section 16. The second channel (cap) portion 30 is adjacent to the first channel portion 20 at a distal end 24 of the first channel portion 20.

The first channel (base) portion 20 has a distal end 24 and a proximal end 22. The second channel portion 30 has at least one edge portion, and preferably two edge portions 32*a*, 32*b*, that extends wider than the distal end 24 of the first channel portion 20 (f>h). At least one of the edge portions 32*a*, 32*b*, and preferably both of these edge portions, includes a plurality of ventilation openings 34.

Figure 1C:
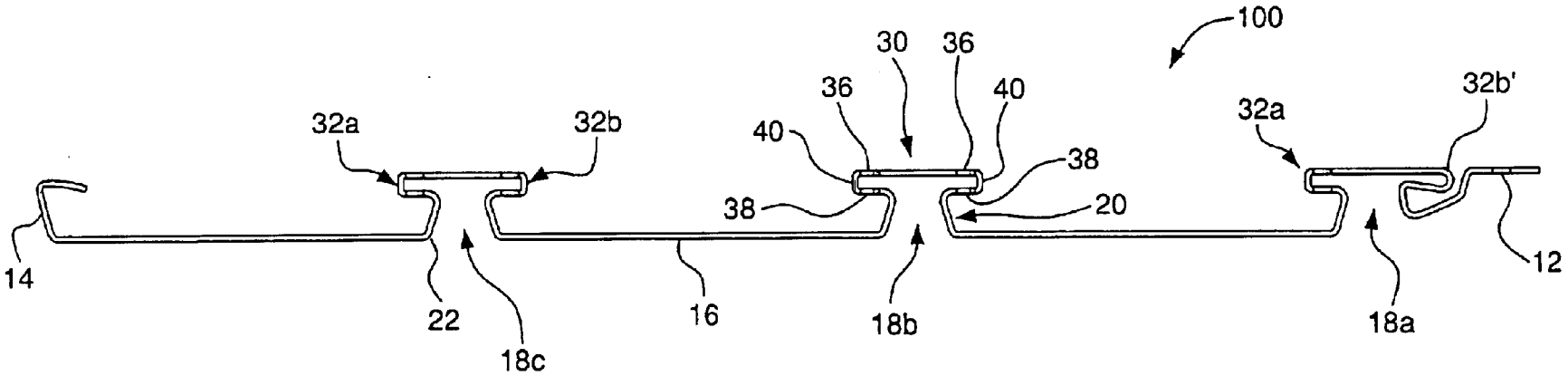
FIG. 1C is cross-sectional side view of the cladding product of FIG. 1A.

As noted above, the second channel (cap) portion 30 preferably includes at least two edge portions 32*a* and 32*b*. As shown in FIG. 1C, both edge portions 32*a*, 32*b* also preferably include an upper segment 36 and a lower segment 38, which are preferably substantially parallel to each other, and to the panel sections 16. The edge portions 32*a* and 32*b* also preferably include a connecting segment 40 which connects the upper and lower segments 36, and 38 of each edge portion.

With particular reference to FIG. 1A, the panel 100 according to a first exemplary embodiment of the present invention preferably comprises three (3) panel sections 16 and three (3) longitudinal recesses 18*a–c*. Each of the longitudinal recesses 18 preferably includes a first channel (base) portion 20 and a second channel (cap) portion 30, wherein the second channel portion 30 includes two (2) edge portions 32*a*, 32*b*. Preferably, the longitudinal recess 18*a* located adjacent to first longitudinal edge portion 12, has ventilation openings 34 on only one edge portion 32*a* (See FIGS. 1A and 1D). As will be noted with reference to FIG. 1C, the longitudinal recess 18*a* is substantially similar to longitudinal recesses 18*b–c* with respect to one edge portion 32*a*, but is dissimilar with respect to the other edge portion 32*b*', which is directly adjacent to first longitudinal edge portion 12. The edge portion 32*b*' provides a means of coupling the panel 100 to other similar panels.

With further reference to FIG. 1A, the first longitudinal edge portion 12 preferably includes a plurality of slots 50 for facilitating the fastening of the panel 100 to a building structure. The second longitudinal edge 14 is preferably shaped to allow interlocking with the outermost longitudinal recess of an adjacent panel.

Figure 1D:
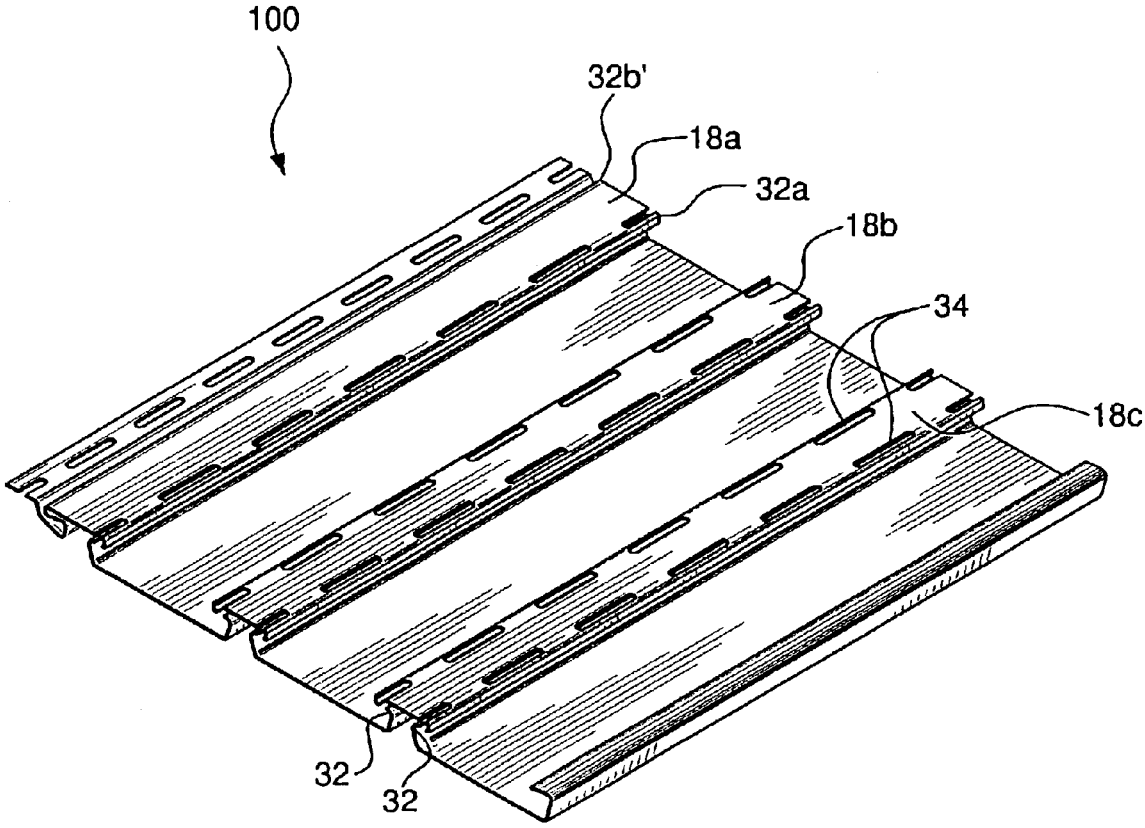
FIG. 1D is a perspective view of the cladding product of FIG. 1A.
Figure 2A:
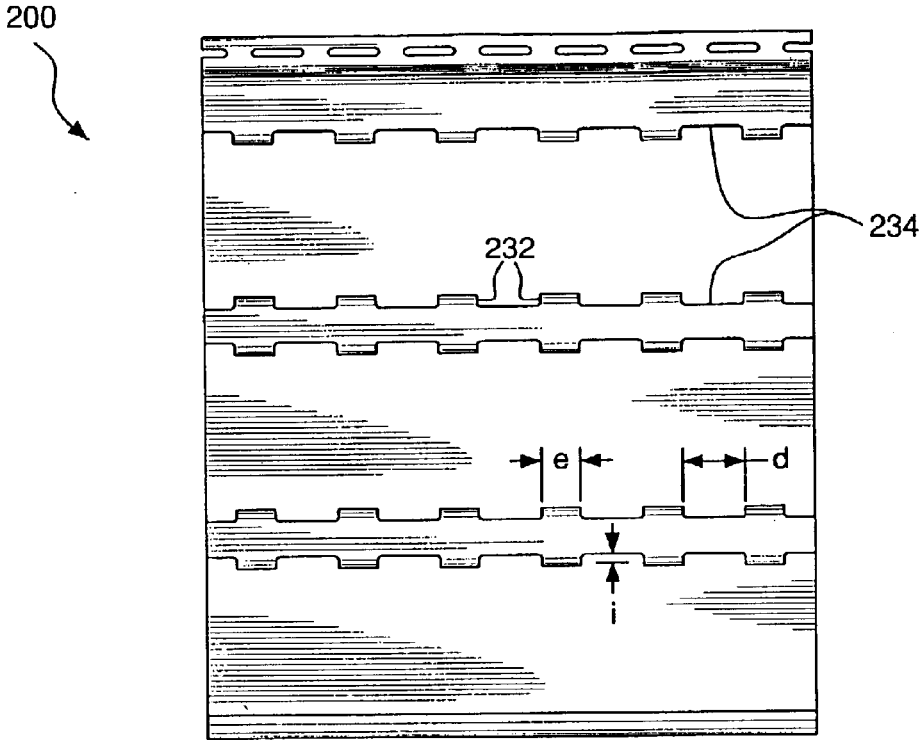
FIG. 2A is a bottom view of a cladding product according to a second exemplary embodiment of the present invention.
Figure 2B:
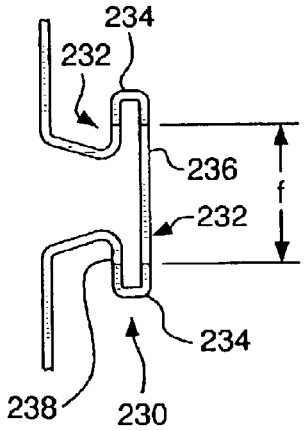
FIG. 2B is a cross-sectional side view of a longitudinal recess of the cladding product of FIG. 2A.
Figure 2C:
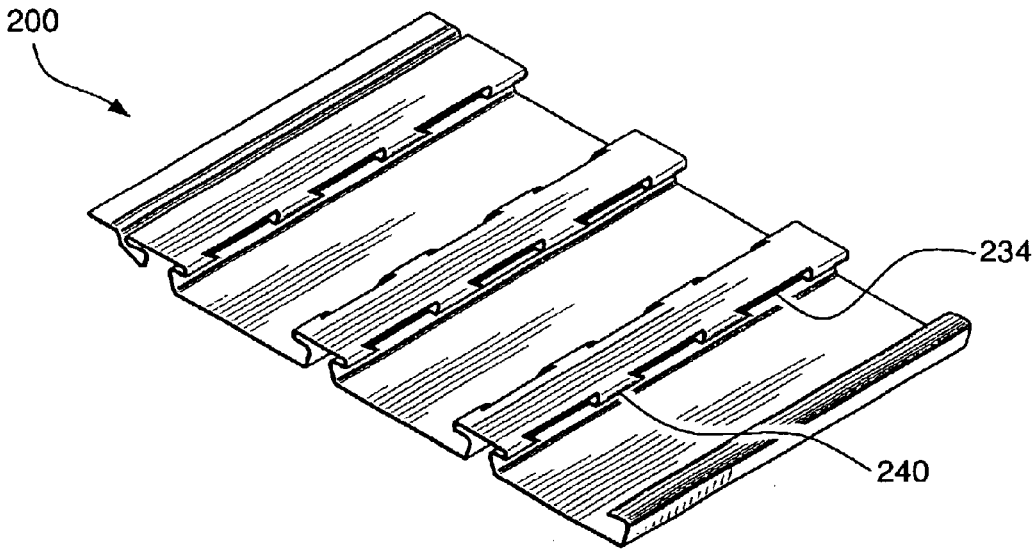
FIG. 2C is an overhead perspective view of the cladding product of FIG. 2A.

As an alternative to the design of FIGS. 1A–1D, and as shown in FIGS. 2A–C, ventilation openings 234 in a second channel (cap) portion 230 may be disposed on a connecting segment 240 of the edge portions 232 of the second channel (cap) portion 230 of panel 200. In this embodiment, the location of the ventilation openings 234 on the edge portions of the second channel (cap) portion 230 also enables the openings to be hidden from view when installed on a building structure.

As shown in FIGS. 1A and 2A, the ventilation openings 34, 234, may be located in alternative areas on the respective edge portions 32, 232 of the second channel (cap) portions 30, 230. In one alternative, as shown in FIG. 1B, the ventilation openings 34 are disposed on the upper and/or lower segments 36, 38 of the edge portions 32*a*, 32*b* of the second channel (cap) portion 30 of panel 100. As shown in FIG. 2B, the ventilation openings 234 may also be disposed on a connecting segment between upper and lower segments 236, 238.

The ventilation openings 34, 234 are preferably sized to provide adequate ventilation or air flow to the respective panel 100, 200. In the first exemplary embodiment shown in FIGS. 1A–D, the ventilation openings 34 are approximately 0.125 inch in width a, between about 1.0 to 1.3 (preferably 1.027 or 1.227) inches in length b, between about 0.75 and 1.0 (preferably 0.773) inch apart c, and between about 0.125 to 0.150 $in^2$ in area. In the second exemplary embodiment shown in FIGS. 2A–C, the ventilation openings 234 are about 1.2 to 1.3 (preferably 1.227) inches in length d, between about 0.13 and 0.14 (preferably 0.134) inch in width i, between about 0.7 to 0.8 (preferably 0.773) inch apart e and about 0.30 $in^2$ in area.

As shown with reference to FIG. 1B, the height f of the second channel (cap) portion 30 is approximately 1.1 inches, and the depth g of the second channel (cap) portion 30 is approximately 0.15 inch. The height h of the first channel (base) portion 20 at the distal end 24 is approximately between about 0.43 to 0.45 inches. This configuration allows the ventilation openings 34 to be adequately sized and hidden from view on the edge portions 32*a*, 32*b* of the second channel (cap) portion 30. It should be noted that the above dimensions are intended only to give perspective to exemplary embodiments of the present invention, and should not be considered restrictive of the present invention. The present invention may be formed with any suitable dimensions while maintaining its unique characteristics.

Figure 3:
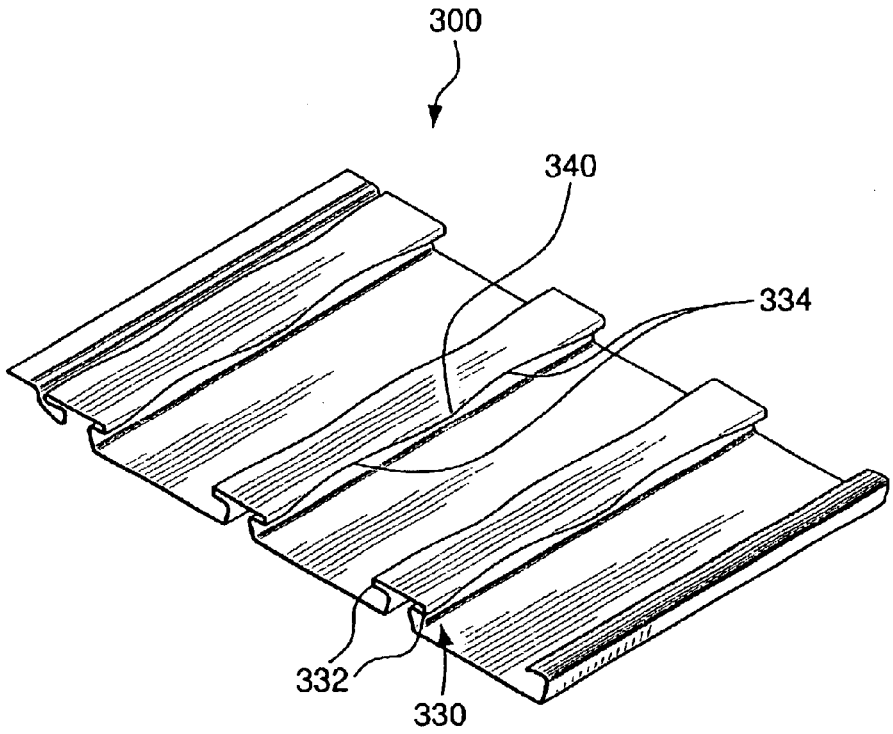
FIG. 3 is an overhead perspective view of a cladding product according to third exemplary embodiment of the present invention.

With particular reference to FIG. 3, another exemplary embodiment of a panel 300 according to the present invention is shown having ventilation openings 334 on the second channel (cap) portion 330 which are disposed on a connecting segment 340 of the edge portions 332 of the second channel (cap) portion 330 of panel 300. The location of the ventilation openings 334 of panel 300 is therefore the same as the location of the ventilation openings 234 of panel 200, with the difference being the shape of the openings. The shape of the ventilation openings 334 may be controlled by the cutting process, as discussed below. As in the embodiment shown in FIGS. 2A–2C, the location of the ventilation openings 334 on the edge portions 332 of the second channel (cap) portion 330 enables the opening s to be hidden from view when installed on a building structure.

Referring to the first through third exemplary embodiments of the present invention, it will be noted that there are various methods for forming the ventilation openings 34, 234, 334 in the longitudinal recesses. FIG. 1D shows the panel 100 with ventilation openings 34 formed by a perforation wheel process. FIG. 2C shows the panel 200 with ventilation openings 234 formed by a blade cutting process. FIG. 3 shows the panel 300 with ventilation openings 334 formed by a router cutting process.

According to another aspect of the present invention, a method for manufacturing siding comprises the steps of extruding a die, forming a panel 100, 200, 300, and forming at least one ventilation hole in the panel on a first side (X) of the panel (see FIG. 1B) such that the ventilation hole (or holes) is not viewable from an opposing side (Y) of the panel. The step of forming at least one ventilation hole may be performed by variety of different cutting processes, which may include, for example, the use of a perforation wheel, a blade cutter or a router.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention.

What is claimed is:

1. A cladding product comprising:

a panel having at least one panel section and at least one longitudinal recess, wherein the at least one longitudinal recess includes a first channel portion adjacent to the at least one panel section, and a second channel portion adjacent to the first channel portion, the second channel portion having a pair of edge portions at opposite ends of the second channel portion from each other, the second channel portion being wider than a width of the first channel portion at an end of said first channel portion distal from the panel, and wherein each edge portion has an upper and lower segment and a connecting segment which connects the upper and lower segments of the respective edge portion, and the edge portions include a plurality of openings disposed on the connecting segment of the edge portions.

2. The cladding product of claim 1, wherein the openings are approximately 0.125 inch in width, between about 1.0 to 1.3 inches in length, and between about 0.75 and 1.0 inch apart.

3. The cladding product of claim 1, wherein the openings are between about 1.2 to 1.3 inches in length, about 0.13 to 0.14 inch in width, and between about 0.7 to 0.8 inch apart.

4. The cladding product of claim 1, wherein the openings are fanned by a perforation wheel process.

5. The cladding product of claim 1, wherein the openings are formed by a blade cutting process.

6. The cladding product of claim 1, wherein the openings are formed by a router cutting process.

7. A vented siding panel comprising:

a planar main body member including at least one ventilation channel disposed therein, wherein the at least one ventilation channel comprises a base portion and a cap portion, and wherein a width of said cap portion is greater than a width of said base portion, and the cap portion has a plurality of ventilation openings at or adjacent to opposite ends thereof, wherein the cap portion of the ventilation channel includes a top wall which is substantially parallel to the planar main body member, at least two sidewalls, and at least one partial bottom wall, and the at least two sidewalls each include at least one ventilation opening formed therein.

8. The vented siding panel of claim 7, wherein the base portion has at least two walls, and the cap portion of the ventilation channel comprises a substantially planar member coupled to respective first ends of the at least two walls of the base portion.

9. The vented siding panel of claim 7, wherein the at least one partial bottom wall of the cap portion is coupled to the base portion of the ventilation channel.

10. The vented siding panel of claim 7, wherein the at least one ventilation channel comprises at least two ventilation channels.

11. The vented siding panel of claim 7, wherein the base portion of the ventilation channel comprises at least two walls which are angled with respect to the planar body member.

12. A cladding product comprising:

a panel having at least one panel section and at least one longitudinal recess, wherein the at least one longitudinal recess includes a first channel portion adjacent to the at least one panel section, and a second channel portion adjacent to the first channel portion, the second channel portion having a pair of laterally extending edge portions at opposite sides of the second channel portion from each other, the second channel portion being wider than a width of the first channel portion at an end of said first channel portion distal from said panel section, and wherein each edge portion has an upper and lower segment and a connecting segment which connects the upper and lower segments of the respective edge portion, and the edge portions include a plurality of openings disposed on the connecting segment of the edge portions.

13. A vented siding panel comprising:

a planar main body member including at least one ventilation channel disposed therein, wherein the at least one ventilation channel comprises a base portion and a cap portion having laterally extending edge portions, and wherein a width of said cap portion between said laterally extending edge portions is greater than a width of said base portion, and the cap portion has a plurality of ventilation openings at or adjacent to lateral edges of said laterally extending edge portions, wherein the cap portion of the ventilation channel includes a top wall which is substantially parallel to the planar main body member, at least two sidewalls, and at least one partial bottom wall, and the at least two sidewalls each include at least one ventilation opening formed therein.

* * * * *